US010211497B1

(12) United States Patent
Hester et al.

(10) Patent No.: US 10,211,497 B1
(45) Date of Patent: Feb. 19, 2019

(54) 3D RF-SUBSTRATE PATTERNING

(71) Applicant: NORTHROP GRUMMAN SYSTEMS CORPORATION, Falls Church, VA (US)

(72) Inventors: Jimmy G. Hester, Atlanta, GA (US); Evan P. Nguyen, Irvine, CA (US); Vesna Radisic, Manhattan Beach, CA (US); Jesse B. Tice, Torrance, CA (US); Andrew D. Smith, Rancho Palos Verdes, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 141 days.

(21) Appl. No.: 15/601,327

(22) Filed: May 22, 2017

Related U.S. Application Data

(60) Provisional application No. 62/465,959, filed on Mar. 2, 2017.

(51) Int. Cl.
*H01P 1/203* (2006.01)
*H01P 3/08* (2006.01)
*H01P 11/00* (2006.01)

(52) U.S. Cl.
CPC ..... *H01P 1/203* (2013.01); *H01P 3/081* (2013.01); *H01P 11/003* (2013.01)

(58) Field of Classification Search
CPC ..... H01P 3/081; H01P 11/003; H01P 1/203
USPC ..... 333/204
See application file for complete search history.

(56) References Cited

U.S. PATENT DOCUMENTS

2004/0155726 A1* 8/2004 Hesselbom ..... H01P 3/081 333/116
2008/0157901 A1* 7/2008 Matekovits ..... H01P 1/203 333/204

OTHER PUBLICATIONS

Matekovits et al., "Controlling the Band limits of TE-Surface Wave Propagation Along a Modulated Microstrip-Line-Based High Impedance Surface", IEEE Transactions on Antennas and Propagation, vol. 56, No. 8, Aug. 2008, pp. 2555-2562. (Year: 2008).*

(Continued)

*Primary Examiner* — Benny T Lee
*Assistant Examiner* — Hafizur Rahman
(74) *Attorney, Agent, or Firm* — John A. Miller; Shumaker, Loop & Kendrick, LLP

(57) ABSTRACT

A microstrip transmission line comprising a dielectric substrate including a series of periodic sinusoidal undulation portions defining spaced apart peaks and troughs, where a distance between the peaks and troughs defines a period of the microstrip line, and where each peak defines a maximum height of the substrate and each trough defines a minimum height of the substrate. The transmission line further includes a conductive strip formed to a surface of the substrate so that the conductive strip follows the undulation portions. The conductive strip includes a modulation portion in a width direction of the conductive strip perpendicular to a signal propagation direction along the strip, where the modulation portion includes a minimum width portion provided at each peak and a maximum width portion provided at each trough so that a variation of a ratio between the width of the conductive strip and the height of the substrate is maximized.

20 Claims, 2 Drawing Sheets

(56) References Cited

OTHER PUBLICATIONS

Monticone et al., "Avoiding conductor width discontinuities at the cell borders in width-modulated microstrip line periodic structures", 2010 International Conference on Electromagnetics in Advanced Applications, 2010, pp. 67-70. (Year: 2010).*

Matekovits et al., Width-Modulated Microstrip-Line Based Mantle Cloaks for Thin Single- and Multiple Cylinders, IEEE Transactions on Antennas and Propagation, vol. 62, No. 5, May 2014, pp. 2606-2615. (Year: 2014).*

Chang et al., "Attenuation in waveguides on FR-4 boards due to periodic substrate undulations", Applied Optics, vol. 46, No. 12 , Apr. 20, 2007, pp. 2234-2243. (Year: 2007).*

Nair, N.V. et al. "An Analysis of a Width-Modulated Microstrip Periodic Structure" IEEE Transactions on Microwave Theory and Techniques, vol. MTT-32, No. 2, Feb. 1984, pp. 200-204.

* cited by examiner

3D RF-SUBSTRATE PATTERNING

CROSS-REFERENCE TO RELATED APPLICATIONS

This application claims the benefit of the priority date of U.S. Provisional Patent Application Ser. No. 62/465,959, titled, 3D RF-Substrate Patterning, filed Mar. 12, 2017.

BACKGROUND

Field

This invention relates generally to an electrical component that has been fabricated by an additive manufacturing printing process and, more particularly, to a microstrip transmission line or a set of transmission lines that has/have been fabricated by an additive manufacturing printing process so that a dielectric substrate associated with the transmission line has variations in thickness that provide a "roller coaster" profile.

Discussion

Additive manufacturing technologies (AMTs) are known in the art that provide document printing applications, such as in the form of ink jet printing. More recently, three-dimensional (3-D) additive manufacturing printing technologies have been employed to generate complex 3-D objects to accommodate a growing interest from consumers, industry and academic research because of their low cost, low environmental footprint and quick cycle time. Radio frequency (RF) engineering research has not been isolated from this movement of AMTs as seen, for example, by recent reports for dielectric structure fabrication, such as lenses.

AMTs have been employed in the art for printing RF electronics, such as multi-material conductor/dielectric antennas, interconnects and circuits. The ability to simultaneously deposit and print dielectrics and conductors allows new RF designs that would be nearly impossible to manufacture without AMTs. In other words, 3-D printing technologies can allow complex RF devices to be fabricated or prototyped that otherwise would not be possible or very difficult by traditional 2.5-D fabrication processes, where the circuits and devices are configured in two-dimensional planes. By employing AMTs that are able to develop full 3-D printed objects, different types of RF elements can be implemented that would not be possible with other technologies. However, even though the current state of the art of fully 3-D printed RF elements and systems includes 2.5-D stacks of parallel plane topologies, there are few disclosures in the art of functional fully 3-D printed structures.

Stereolithography (SLA) is an additive manufacturing technology that often times is employed for 3-D printing of RF electronic elements. An SLA apparatus typically employs an ultraviolet laser source that focuses a laser beam into a vat containing a photopolymer resin. The photopolymer resin can be selected so that it provides the desired dielectric properties and may include appropriate particles to make the resin conductive. The laser beam is selectively directed in a controlled manner using computer aided design software so as to cause the laser beam to follow a predetermined pattern. Because the photopolymer resin is photosensitive under ultraviolet light, the resin solidifies when exposed to the UV light to form a layer of the solid resin in the desired pattern, where the layers are continually built up to form the 3-D object.

SUMMARY

The present invention discloses and describes a microstrip transmission line that includes a dielectric substrate having a series of periodic sinusoidal undulation portions defining spaced apart peaks and troughs, where a distance between the peaks and troughs defines a period of the microstrip line, and where each peak defines a maximum height of the substrate and each trough defines a minimum height of the substrate. The transmission line further includes a conductive strip formed to a surface of the substrate so that the conductive strip follows the undulation portions. The conductive strip includes a modulation portion in a width direction of the conductive strip perpendicular to a signal propagation direction along the strip, where the modulation portion includes a minimum width portion provided at each peak and a maximum width portion provided at each trough so that the variation range of the ratio between the width of the conductive strip and the height of the substrate is maximized to maximize the variation range of the characteristic impedance of the transmission line. In one embodiment, the transmission line is fabricated by an additive manufacturing process. The transmission line can be part of a filter, where multiple transmission lines may be electromagnetically coupled.

DETAILED DESCRIPTION OF THE EMBODIMENTS

The following discussion of the embodiments of the invention directed to a microstrip transmission line that has been fabricated by an additive manufacturing process is merely exemplary in nature, and is in no way intended to limit the invention or its applications or uses. For example, although the described invention is specific to microstrip transmission lines, the concept of employing AMTs for fabricating dielectric substrates that have variations in thickness can be extended to other devices.

Figure 1:
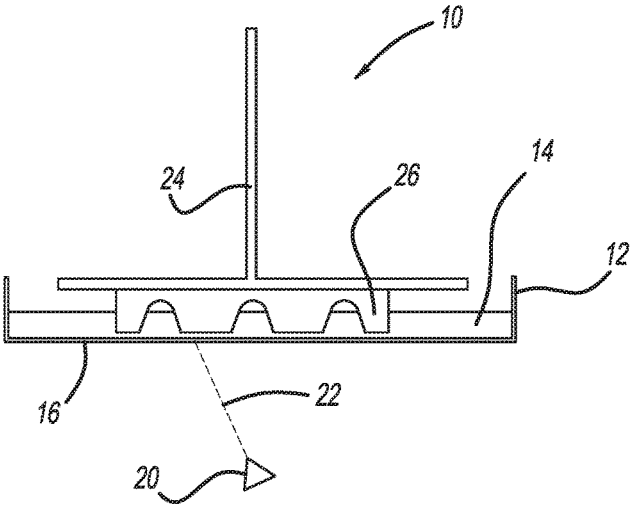
FIG. 1 is a schematic diagram of an SLA apparatus that can be employed for fabricating a 3-D RF circuit.

FIG. 1 is a schematic diagram of an SLA machine 10 including a vat 12 containing a photopolymer resin 14. The resin 14 is specially selected for a particular 3-D object 26 being fabricated, where many suitable resins are known to those skilled in the art. A transparent plate 16 is provided at a bottom part of the vat 12, and an ultraviolet laser 20 selectively directs a laser beam 22 through the plate 16 under computer aided design control so as to selectively cure the resin 14 at the locations that receive the beam 22 to cause the resin 14 to harden into the desired shape for the object 26. The resin 14 is cured to a selected depth depending on the intensity of the beam 22 and other factors so that only a relatively thin layer of the resin 14 is being cured at any particular point in time. Once a particular layer is fully cured, a build plate 24 mounted to the object 26 opposite to the plate 16 incrementally lifts the object 26 the distance corresponding to the thickness of the layer. This process is repeated until the object 26 is completely fabricated in a manner that is well understood by those skilled in the art.

An electromagnetic band gap (EBG) structure is a 3-D engineered structure that has a periodic configuration. An EBG structure interacts with electromagnetic waves so as to prevent the propagation of electromagnetic waves in specific frequency bands, where the EBG structure can provide stop-bands, pass-bands and band-gaps, which have various applications, such as filtering applications. Microstrip transmission lines have many applications in various RF electronics for many types of devices, and are often employed for filtering purposes. Thus, EBG structures have been known to be employed as microstrip transmission lines at various frequency bands of interest.

As is well understood by those skilled in the art, a transmission line will have a characteristic impedance relative to the frequency of the RF signal propagating thereon that is defined by the ratio of the magnitude of the magnetic and electric fields of the signal. This ratio of the magnitude of the magnetic and electric fields is thus determined by the width and height of the transmission line, specifically the width of the microstrip conductor and the height of the dielectric substrate on which the conductor resides. It has been proposed in the art to vary the width of the microstrip conductor in a periodic manner so as to change the characteristic impedance of the transmission line to form an EBG structure.

The present invention proposes employing AMTs, such as SLA printing techniques, for fabricating a microstrip transmission line to also gradually and periodically change the height of the dielectric substrate of the transmission line so as to further increase the variation range of the ratio of the width of the conductor to the height of the dielectric substrate to provide a greater change in the characteristic impedance of the microstrip line. In other words, by periodically increasing the ratio between the width of the conductor and the height of the dielectric substrate the efficiency of the EBG structure to reject certain frequency bands can be dramatically increased.

Figure 2:
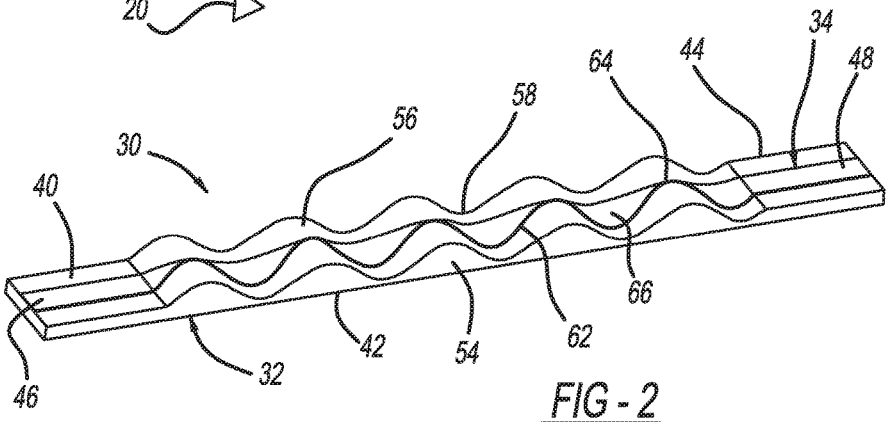
FIG. 2 is an isometric view of a microstrip transmission line including a sinusoidal patterned substrate fabricated by a 3-D printing process.
Figure 3:
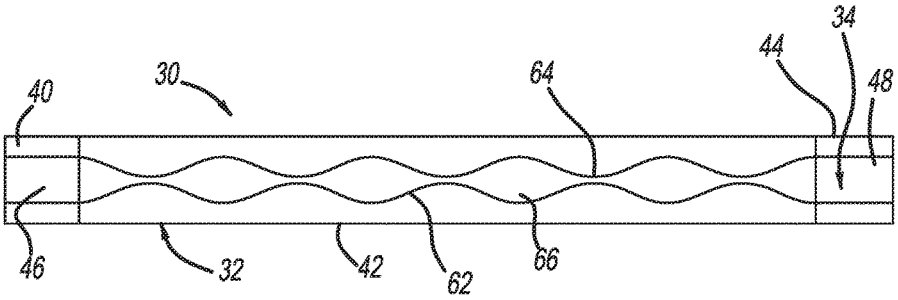
FIG. 3 is a top view of the microstrip transmission line shown in FIG. 2.

FIG. 2 is an isometric view and FIG. 3 is a top view of a microstrip transmission line 30 that has been fabricated by an additive manufacturing technology, such as SLA, for example, by the SLA machine 10. The transmission line 30 includes a dielectric substrate 32 having a certain width and a certain height H on which is fabricated or deposited a conductive strip 34 also having a certain thickness and a certain width W. As mentioned, the characteristic impedance of the transmission line 30 is related to the ratio of the width W of the conductive strip 34 to the height H of the substrate 32, i.e., W/H. The actual width W and height H would depend on the frequencies and fabrication techniques being employed for a particular application.

Figure 4:
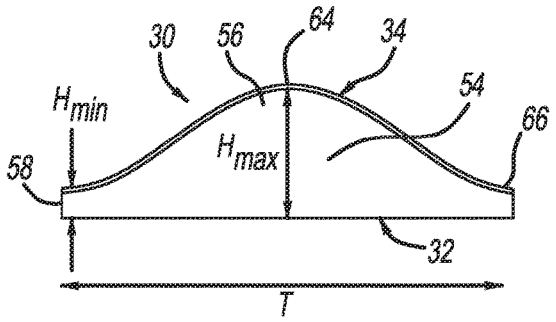
FIG. 4 is a side view of a portion of the transmission line shown in FIGS. 2 and 3.

The dielectric substrate 32 includes a flat input portion 40, a modulated filtering portion 42 and a flat output portion 44, where the conductive strip 34 has an input strip portion 46 deposited on the input portion 40 and an output strip portion 48 deposited on the output portion 44, which have a constant width W. The filtering portion 42 includes a series of undulations 54 defining a sinusoidal configuration having peaks 56 and troughs 58, where each undulation 54 defines a period T of the microstrip line 30. FIG. 4 is a side-view of one of the undulations 54 of the microstrip line 30 showing the relationship between the height $H_{min}$ of the troughs 58 and the height $H_{max}$ of the peaks 56. Although a sinusoidal configuration of the substrate 32 is provided, other shapes may be applicable, such as a saw tooth configuration.

Figure 5:
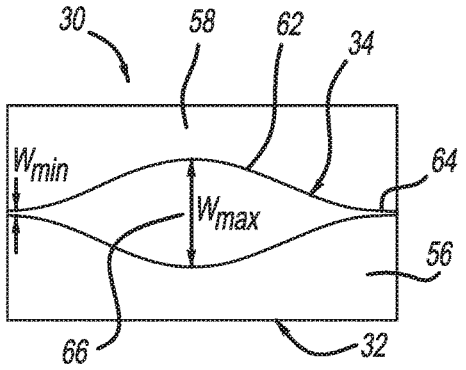
FIG. 5 is a top view of a portion of the transmission line shown in FIGS. 2 and 3.

The conductive strip 34 includes a modulation portion 62 formed on the filtering portion 42 that continually, gradually and sinusoidally tapers in width W from a narrow portion 64 defined by width $W_{min}$ provided on each peak 56 to a wide portion 66 defined by width $W_{max}$ provided on each trough 58. FIG. 5 is a top view of one of the undulations 54 showing the relationship between the widths $W_{min}$ and $W_{max}$. Therefore, in this configuration, a maximum variation of the ratio between the width W of the conductive strip 34 and the height H of the dielectric substrate 32 is provided along the entire length of the filtering portion 42 of the microstrip line 30, which increases the variation range of the characteristic impedance of the line 30 and the frequency band rejection.

The structure of the proposed transmission line 30 relies on the full 3-D dielectric and conductor fabrication capabilities provided by the AMT. The transmission line 30 employs the 3-D dimensions of space in a smooth manner in order to provide a periodic and sinuosoidally-modulated thickness. From an electrical standpoint, this height modulation of the filtering portion 42 translates into a periodic variation of the transmission lines characteristic impedance, whose value is exclusively a function of W/H and the relative dielectric permittivity $\varepsilon_r$ of the substrate 32. Although similar planar structures that rely exclusively on the modulation of the conductor width have previously been reported and demonstrated in the art, the present invention allows the characteristic line impedance variation range to be magnified by the simultaneous modulation of the width W of the conductive strip 34 and the height H of the substrate 32.

For a given metallization resolution, and a maximum width specification, the addition of the height modulation of the substrate 32 provided by a full 3-D design can provide a significant performance increase. This has been illustrated by HFSS-simulated lossless S-parameters of the structure with and without thickness modulation. For a set width modulation amplitude of 2.9 mm, where $W_{min}$=0.1 mm, $W_{max}$=3 mm and T=10 mm, the addition of a thickness modulation of the substrate 32, where the modulation range of W/H is increased from 0.091; 2.73 to 0.038; 6, increases the maximum rejection by 43 dB from −14 dB to −57 dB. This is achieved by the addition of a third dimension in this design for otherwise exact identical dimensions.

In one non-limiting embodiment, the substrate 32 was 3-D printed with a Formlabs™ Form 2 stereolithography (SLA) printer using a Formlabs GPCL 02 ™ clear resin. The conductive strip 34 was then conformally printed with an Optomec™ aerosol system using two layers of Advanced Nano Products™ AS 1:4 silver nano-particles (SNP) ink. The printed SNP trace was then increased to 100° C. for 1 hour. The substrate 32 was then backed with copper tape and interfaced with a coaxial connector (not shown) before being measured.

The discussion above concerning the microstrip transmission line 30 being fabricated by additive manufacturing technologies allows the variation in the height of the substrate 32. As discussed, all known microstrip transmission lines have a constant thickness substrate. It is noted, that the ability to provide variations in the thickness of a dielectric substrate as described may be relevant to other types of RF devices and elements that could benefit from such a configuration.

It is further understood by those skilled in the art that electromagnetic coupling occurs between transmission lines that are in proximity to one another. The strength of the electromagnetic coupling between microstrip lines depends on conductor width, conductor height, and the spacing between the conductors. It is noted that electromagnetic coupling is a desirable and necessary feature for certain types of filters.

As mentioned above, the microstrip transmission line 30 may be employed for certain filtering applications, where a signal provided at an input side of the line 30 is filtered by the characteristic impedance of the line 30 as described to provide an output signal that is limited to a certain frequency band. In an alternate embodiment, electromagnetic coupling between two or more such microstrip transmission lines may benefit from the AMT process discussed above through changing the height of the dielectric substrate.

Figure 6:
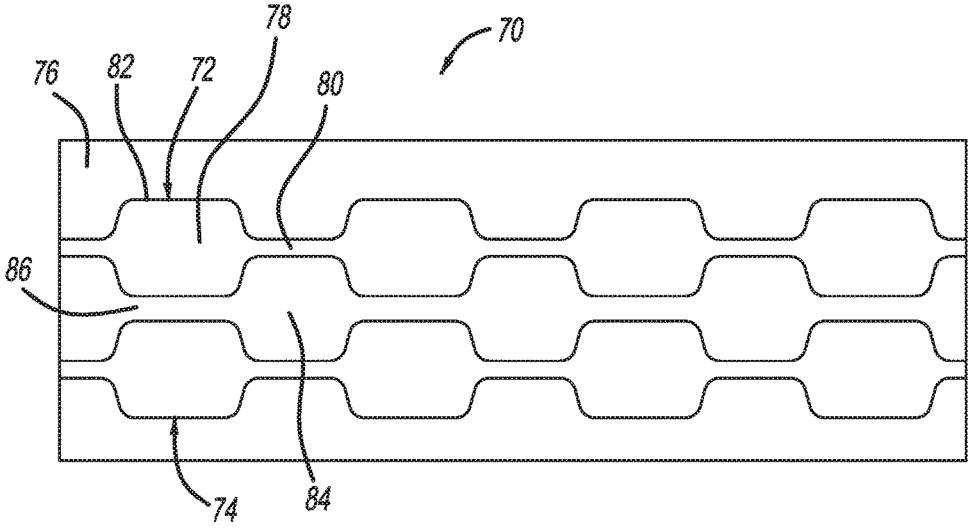
FIG. 6 is a top of view of a filter including coupled microstrip transmission lines fabricated by a 3-D printing process.

This embodiment is illustrated in FIG. 6 which shows a top view of a filter 70 fabricated by an AMT and including two parallel conductive strips 72 and 74 formed on a dielectric substrate 76. The conductive strips 72 and 74 have a sinusoidal configuration including wide portions 78 and narrow portions 80, where the wide portions 78 have a different shape than the wide portions 66 of the conductive strip 34. Particularly, the wide portions 78 have a straight section 82 instead of the gradual taper of the wide portions 66. The substrate 76 includes undulations in the same manner as the substrate 32 so as to have peaks and troughs that define a period of the conductive strips 72 and 74, where the peaks align with the narrow portions 80 and the troughs align with the wide portions 78. The conductive strips 72 and 74 are formed on the substrate 76 a defined distance apart to provide a gap 84 having a certain width between the narrow portions 80 and a gap 86 having a certain width between the wide portions 78.

A signal propagating on the conductive strip 72, for example, from the left side to the right side, will be impedance controlled in the manner discussed above by the configuration of the narrow portions 80 and the wide portions 78 of the strips 72 and 74 relative to the peaks and troughs in the substrate 76. Electromagnetic energy generated by the signal propagating along the strip 72 will be coupled into the conductive strip 74 depending on various design criteria, such as the size of the gaps 84 and 86, the relative dimensions between the wide portions 78 and the narrow portions 80, the particular materials being employed, etc. Therefore, the electromagnetic energy generated by the conductive strip 72 from a signal propagating thereon creates a current flow in the conductive strip 74, but traveling in an opposite direction. By selecting the various parameters discussed herein, the input signal can be filtered to a certain desired frequency band of interest, and further, the strength of the coupling between the conductive strip 72 and 74 can be controlled so that a desired amount of the input power can be obtained, such as providing a signal tap. It is noted that although the filter 70 includes the two conductive strips 72 and 74, alternate embodiments may include more than two conductive strips to provide various levels of capacitive coupling.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A microstrip transmission line comprising:

a dielectric substrate including a series of periodic undulation portions defining spaced apart peaks separated by troughs, where a distance between the peaks and the troughs defines a period of the transmission line and where each peak defines a maximum height of the substrate and each trough defines a minimum height of the substrate; and a conductive strip formed to a surface of the substrate so that the conductive strip follows the undulation portions in the dielectric substrate, said conductive strip including a modulation portion configured in a width direction of the conductive strip perpendicular to a signal propagation direction along the strip, where the modulation portion includes a minimum width portion provided at the peak of each undulation portion and a maximum width portion provided at the trough of each undulation portion so that a variation of ratio between the width of the conductive strip and the height of the substrate is maximized.

2. The microstrip transmission line according to claim 1 wherein the modulation portion has a generally continuous taper between each minimum width portion and maximum width portion.

3. The microstrip transmission line according to claim 1 wherein the maximum width portion includes a straight section and a tapered portion between the minimum width portion and the straight section of the maximum width portion.

4. The microstrip transmission line according to claim 1 wherein the undulation portions in the dielectric substrate and the modulation portions of the conductive strip define an electromagnetic band gap (EBG) structure.

5. The microstrip transmission line according to claim 1 wherein the microstrip transmission line is fabricated by an additive manufacturing process.

6. The microstrip transmission line according to claim 5 wherein the additive manufacturing process is a stereolithography 3-D printing process.

7. The microstrip transmission line according to claim 1 wherein the transmission line has a characteristic impedance profile provided for filtering purposes.

8. The microstrip transmission line according to claim 1 wherein the transmission line is part of a filter.

9. The microstrip transmission line according to claim 8 wherein the transmission line is one transmission line of multiple coupled transmission lines to construct the filter.

10. A filter comprising:

a dielectric substrate including a series of periodic undulation portions defining spaced apart peaks separated by troughs where each peak defines a maximum height of the substrate and each trough defines a minimum height of the substrate;

a first conductive strip formed to a surface of the substrate so that the first conductive strip follows the undulation portions in the dielectric substrate; and a second conductive strip formed to the surface of the substrate and being generally parallel to the first conductive strip so that the second conductive strip also follows the undulation portions in the dielectric substrate, where both the first and second conductive strips include a respective modulation portion configured in a width direction of the conductive strip perpendicular to a signal construct propagation direction along the strip, and where the modulation portion includes a minimum width portion provided at the peak of each modulation portion and a maximum width portion provided at the trough of each undulation portion so that a variation of a ratio between the width of the first and second conductive strips and the height of the substrate is maximized, wherein a signal propagating along the first conductive strip is electromagnetically coupled into the second conductive strip.

11. The filter according to claim 10 wherein the respective modulation portion in both the first and second conductive strips has a generally continuous taper between each minimum width portion and maximum width portion.

12. The filter according to claim 10 wherein the maximum width portion in both the first and second conductive strips includes a straight section and a tapered portion between the minimum width portion and the straight section of the maximum width portion.

13. The filter according to claim 10 wherein the undulation portions in the dielectric substrate and the modulation portions of the first and second conductive strip define an electromagnetic band gap (EBG) structure.

14. The filter according to claim 10 wherein the filter is fabricated by an additive manufacturing process.

15. The filter according to claim 14 wherein the additive manufacturing process is a stereolithography 3-D printing process.

16. A transmission line fabricated by an additive manufacturing process, said transmission line comprising:

a dielectric substrate including a series of periodic undulation portions defining spaced apart peaks separated by troughs, where a distance between the peaks and the troughs defines a period of the transmission line; and a conductive strip formed to a surface of the substrate so that the conductive strip follows the undulation portions in the dielectric substrate, said conductive strip including a modulation portion configured in a width direction of the conductive strip, where the modulation portion includes a minimum width portion provided at the peak of each undulation portion and a maximum width portion provided at the trough of each undulation portion.

17. The transmission line according to claim 16 wherein the modulation portion has a generally continuous taper between each minimum width portion and maximum width portion.

18. The transmission line according to claim 16 wherein the maximum width portion includes a straight section and a tapered portion between the minimum width portion and the straight section of the maximum width portion.

19. The transmission line according to claim 16 wherein the undulation portions in the dielectric substrate and the modulation portions of the conductive strip define an electromagnetic band gap (EBG) structure.

20. The transmission line according to claim 16 wherein the transmission line is part of a filter.

* * * * *